US005403398A

United States Patent [19]

Riess et al.

[11] Patent Number: 5,403,398

[45] Date of Patent: Apr. 4, 1995

[54] MAIL TRACKER WITH ZIP BREAK MARKER

[76] Inventors: Robert Riess, 713 Forestview, Park Ridge, Ill. 60068; John Harisiadis, 2302 North Pine Ave., Arlington Heights, Ill. 60004; Kasimir G. Rudak, 119 Elm St., Glenview, Ill. 60025; Fred Lieder, 3807 Jarvis Ave., Lincolnwood, Ill. 60645; Elmer Nelson, 4501 N. Harding, Chicago, Ill. 60625

[21] Appl. No.: 919,344

[22] Filed: Jul. 23, 1992

[51] Int. Cl.[6] ..... B05C 11/00; B07C 5/00

[52] U.S. Cl. ..... 118/681; 118/264; 118/680; 209/547; 209/569; 209/900

[58] Field of Search ..... 118/680, 681, 682, 696, 118/712, 676, 679, 264; 209/547, 569, 608, 900

[56] References Cited

U.S. PATENT DOCUMENTS

| | | | |
|---|---|---|---|
| 4,033,283 | 7/1977 | Rusk | 118/681 |
| 4,328,962 | 5/1982 | Akers . | |
| 4,497,040 | 1/1985 | Gomes et al. . | |
| 4,503,976 | 3/1985 | Cloud et al. | 209/900 |
| 4,530,306 | 7/1985 | Havecamp | 118/681 |
| 4,534,313 | 8/1985 | Louvel | 118/696 |
| 4,601,396 | 7/1986 | Pavie . | |
| 4,646,245 | 2/1987 | Prodel et al. . | |
| 4,770,122 | 9/1988 | Ichihashi et al. | 118/696 |
| 5,186,336 | 2/1993 | Pippin et al. | 209/900 |

FOREIGN PATENT DOCUMENTS

| | | | |
|---|---|---|---|
| 2577151 | 8/1986 | France | 209/547 |

*Primary Examiner*—Joye L. Woodard

*Attorney, Agent, or Firm*—Millen, White, Zelano & Branigan

[57] ABSTRACT

An electronic mail tracking system having automatic zip code break marking capability. A series of optical sensors along the mail piece transport path of the tracking system track the progress of the mail pieces. A felt tip marker removably mounted to a solenoid is selectively extended and retracted to mark zip code breaks and the mail pieces are then transported to a stacker. The system provides high speed, reliable and low cost zip break marking and tracking of mail piece.

10 Claims, 4 Drawing Sheets

70
72
74
76
78
80
82
84
86
88
90
91
92
94
96
98
100
102
104
106
108

MAIL TRACKER WITH ZIP BREAK MARKER

BACKGROUND OF THE INVENTION

This invention relates generally to the field of mail processing and tracking equipment, and in particular to an improved electronic mail tracking system having automatic zip code break marking capability.

Various machines for automatically processing mail pieces at high speed are finding increasing wide spread use in commercial and governmental institutions. Such mail piece processing systems, for example, mail sorting, tracking and bar code application systems, typically include an envelope stacking apparatus to secure the mail pieces in a stacked position to facilitate manual removal of processed mail pieces from the system. The stacked mail pieces are manually or automatically removed from the stack and/or bound by an operator. In some mail processing systems, the mail pieces are typically grouped according to zip codes, and it is desirable that each zip code group be removed from the stacker and bound separately. By doing so, mail rates can be reduced.

In view of the foregoing, it is an object of the present invention to provide a novel method and apparatus for tracking and stacking mail pieces at high speed and automatically marking the first mail piece in each zip code group to facilitate removal of mail grouped according to zip code from the stack.

It is another object of the invention to provide a novel method and apparatus for automatically marking of mail piece zip code groups which is reliable and inexpensive to maintain and operate.

The above objects and advantages, among others, are provided by the apparatus and method for automatically tracking mail pieces, marking zip code breaks, and stacking mail pieces disclosed herein. In one embodiment, the invention includes a mail piece tracker in which successive photosensors track the position of each respective mail piece, and control circuitry activates a marker solenoid in response to the photosensors to mark selected mail pieces.

In accordance with one embodiment, apparatus is provided for tracking and marking objects transported along a transport path including means for tracking the position of the objects and generating position signals indicative of the position of the objects in the transport path. In addition, means are provided for receiving control signals, and a marking means is provided for marking a surface with a mark suitable for indicating a zip break, together with mounting means positioned in proximity to the transport path for movably mounting the marking means such that the marking means can be automatically positioned. Means for acting on the marking means are provided to position the marking means between a first position in which the marker means can contact a passing object in the transport path, and a second position in which the marking means cannot contact the passing object in the transport path. Control means controls the means for acting to position the marker in the first position to mark a selected passing object in response to the position signals and the control signals, and to position the marker in the second position in response to the position signals.

BRIEF DESCRIPTION OF THE DRAWINGS

The invention, together with further objects and advantages thereof, may be understood by reference to the following description taken in conjunction with the accompanying drawings.

DETAILED DESCRIPTION OF THE INVENTION

Figure 1:
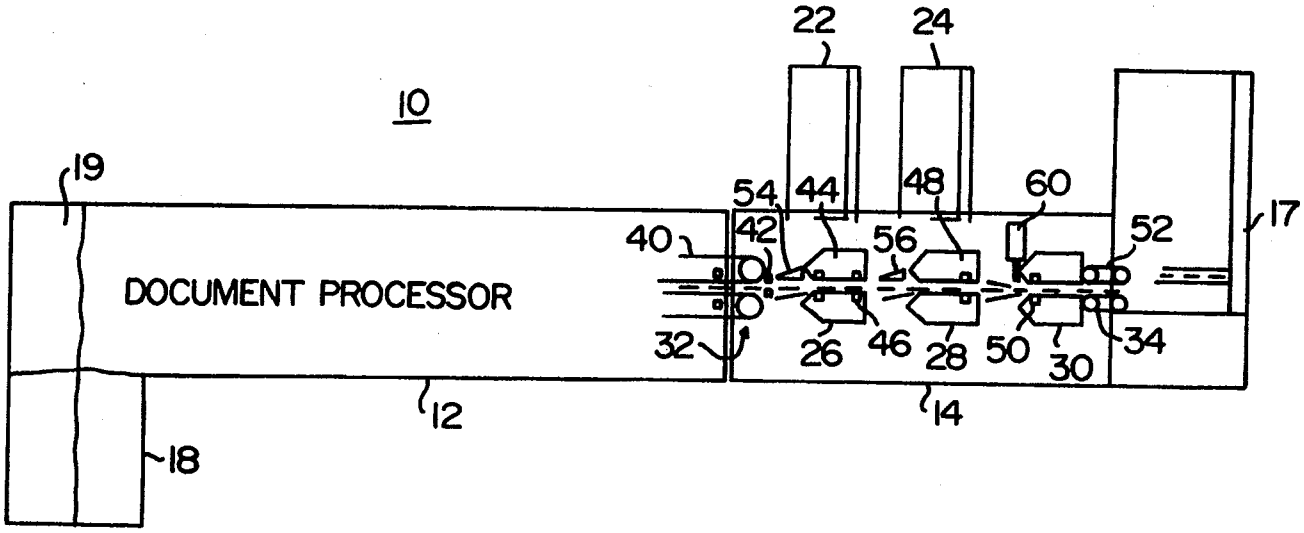
FIG. 1 is a general diagrammatic top view of a mail processing system with zip break marking tracker in accordance with the invention.

FIG. 1 is a generalized diagrammatic illustration of a specific embodiment of a document handling system 10 for handling mail piece documents and the like including a document processor section 12, a zip break marking tracker 14, and a stacker 16. In the illustrated embodiment, the document processor 12 comprises a computerized system for transporting documents from an input bin along a transport path in which address information on the documents may, for example, be read using an optical reader, printed with alphanumeric and/or bar code information (i.e., a bar code of the zip code) and passed onto the tracker 14. The central processor 19 of the processor section 12 keeps track of the information about each document such as location in the transport path and the zip code. Such document processing apparatus is known in the art and suitable examples are disclosed in co-pending patent application entitled "Mail Sorting Apparatus and Method" filed on Oct. 6, 1990, bearing Ser. No. 07/598,189, and entitled "Method and Apparatus for Object Surveillance Along a Transport Path", filed Nov. 2, 1990, bearing Ser. No. 07/600,641, which are hereby incorporated by reference.

In the illustrated embodiment of FIG. 1, the zip break marking tracker 14 includes two auxiliary document trays 22, 24. A transport path includes three belt based document transport assemblies 26, 28, 30, as well as a set of entry belt pulleys 32, and a set of exit belt pulleys 34. These transport assemblies function using belt drive to transport documents along the transport path from the entry pulley 32 to the exit pulley 34 in the conventional manner well known in the art. In addition, seven pairs (i.e., an optical emitter and an optical detector) of photo detectors 40, 42, 44, 46, 48, 50, and 52 are provided to track the progress of documents along the transport path. A zip break marker 60 is mounted, as shown, next to the transport path assembly 30. Document steering gates 54 and 56 are provided to permit directing documents into the auxiliary trays 22, 24.

In operation, the document processor section 12 transports the documents to a belt drive transport assembly including the entry belt pulley 32 which transports the documents in an upright position into the tracker transport path. In addition, the document processor 12 also couples control signals including a zip break signal and gate control signals to the tracker 14 electronics indicating when a change in zip code has occurred. The system can be programmed to indicate zip code changes on a three digit or five digit change basis (i.e., a change in the least significant digit of the five digit zip code or in the third most significant digit of the five digit zip code).

The document may thus be transported along the transport path in an upright position and tracked by the photodetector pairs as it is transported along the transport path starting with the first photodetector pair 40 mounted at the end of the transport path of the document processing section 12, as shown. The photodetector pairs 42, 44, 46, 48, 50, 52 permit continued tracking of the document along the tracker transport path and control of the zip break marker. Thus, as the document is transported along the transport path and is detected by the photodetector pair 48, the zip break marker may be activated after a predetermined delay (e.g., 30 ms) to mark the document if a zip break is indicated by the zip break signal so as to mark the edge of the document. The zip break marker is deactivated when the document is detected by the detector pair 50, and the document is finally detected leaving the tracker 14 by the last photodetector pair 52. At this point, the document is conveyed into the stacker 16. In the illustrated embodiment, the stacker transports the upright document until it hits the back plate 17 of the tracker and then stacks the document in the conventional manner such that the zip break mark can be easily seen along the edge of the resulting stack of documents.

Alternatively, if gate control signals were generated by the processor 19, the signal controls one of the gates 54, 56. Thus, for example, the first gate 54 may be activated to divert documents having no zip code into the bin 22 while the second gate 56 might be activated to direct all documents having the local zip code into the bin 24.

Figure 2A:
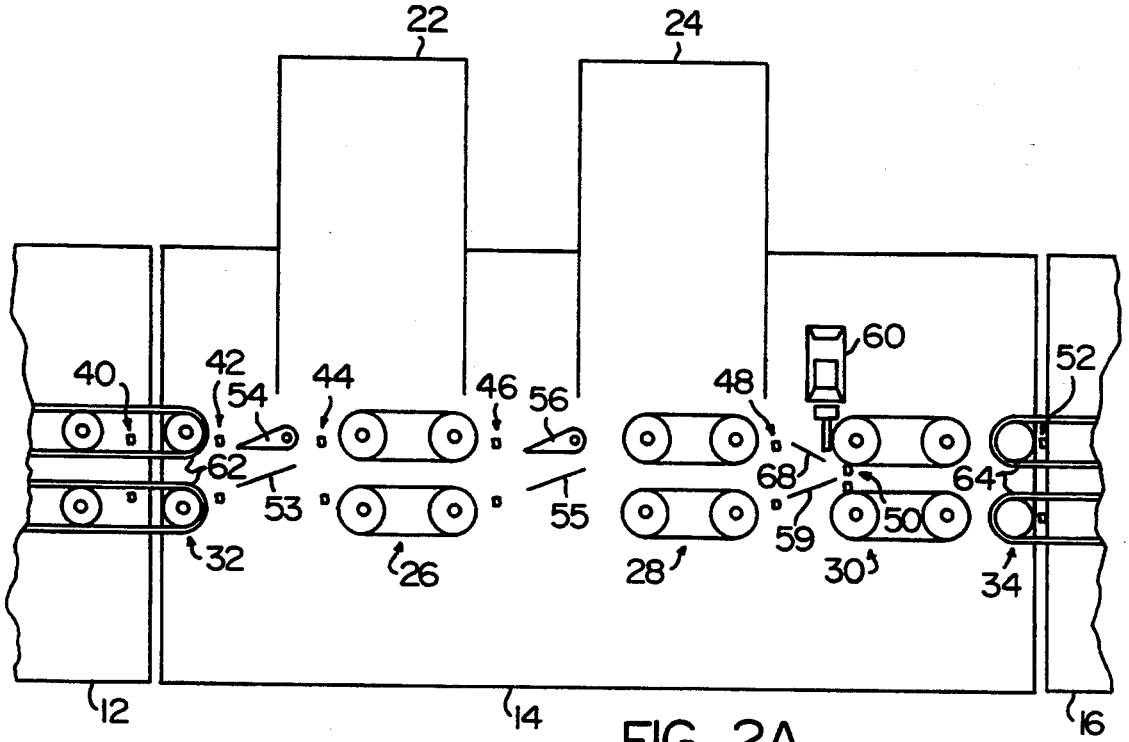
FIG. 2A is a detailed diagrammatic top view of a specific embodiment of the mail zip break marking tracker in accordance with the invention.

FIG. 2A is a detailed diagrammatic top view illustration of a specific embodiment of the tracker 14 with transport assembly plates 100 (see FIG. 2B) removed. As shown, the set of belts 62 extend from the processor section 12 over to the entry belt pulleys 32 of the tracker 14. Documents, typically in the upright position, are transported from the processor section 12 to the tracker section 14 by contact with the moving belt 62 which are powered by rotation of the pulleys powered by a motor (not shown) in the conventional manner well-known in the art. The document is initially detected by the photodetector pair 40 and then by the photodetector pair 42. If the document is to be diverted into the bin 22, a control signal from the processor section activates the gate 54 turning it (e.g., by means of a solenoid) to intercept the path of the document, thereby diverting it into the bin 22. The guide 53 also guides the document to permit it to be diverted or to continue along the transport path if the gate 54 is not activated. If the document is not diverted by gate 54, the document is transported further along the transport path by the belt transport assembly 26, detected first by the photodetector pair 44, and then by the photodetector pair 46. If the document is to be diverted into bin 24, the gate 56 is activated by turning it into the path of the document in response to a control signal from the processor section 12. If the document is to continue along the transport path, the gate 56 is not activated and in conjunction with a guide 55, directs the document to the belt transport assembly 28 which transports the document further along the transport path. A short delay after the leading edge of the document is detected by the photodetector pair 48, the zip marker 60 may be activated to mark the edge of the passing document. Guides 58 and 59 direct the document along the transport path to the belt transport assembly 30 which transports the document toward the exit pulleys 34. The photodetector pair 50 detects the leading edge of the document and deactivates the zip marker in response thereto. The document is then transported to the transport belts 64, which in conjunction with the exit pulleys 34, convey the document to the stacker 16. The photodetector pair 52 detects the leading edge of the document as it leaves the tracker.

Figure 2B:
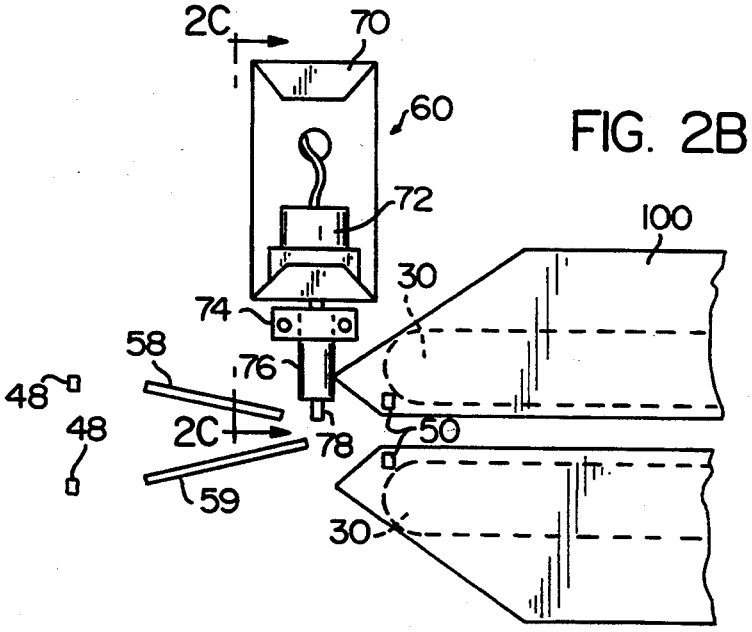
FIG. 2B is a close-up view of a specific embodiment of the zip break marker mechanism of the zip break marking tracker in accordance with the invention.

Referring now to FIG. 2B, there is shown a detailed top view of a specific embodiment of the zip break marker 60 which includes a solenoid 72 mounted in a housing base 70 with a bracket 74 connected to the solenoid, and a marker 76 mounted in the bracket. In the illustrated embodiment, the marker 76 may be a conventional consumer felt marker (e.g., Major Accent marker marketed to Sanford Corporation, Bellwood, Ill. 60106). The transport assembly 30 is also shown including transport assembly plates 100. The document guides 58, 59 guide the incoming document along the transport path and the longer guide 59 also provide support when the zip break marker tip 78 contacts the document.

In operation, as the document approaches the zip marker, its leading edge is detected by the photodetectors 48, and it is guided by guides 58, 59. If a zip break mark is to be made on the document, a control signal from the processor section 12 initiates activation of the solenoid 70 to an extended position after a small delay, extending the bracket and marker outward toward the transport path. As the leading edge of the document passes, it is contacted by the tip 78 of the extended marker, thus marking the edge of the document. The document may tend to bend away from the marker due to the pressure from the tip 78. To prevent this, the guide 59 may be made slightly longer than the guide 58, as shown, to support the document when contacted by the tips 78. After the leading edge of the document passes the tip of the marker, it is detected by the photodetector pair 50. The solenoid is then deactivated in response to the detection by the photodetector pair 50, retracting the marker 76 and bracket 74 so that the tip 78 no longer contacts the document. The marker remains in the retracted position until the next zip break signal activates the solenoid.

Figures 2C, 3:
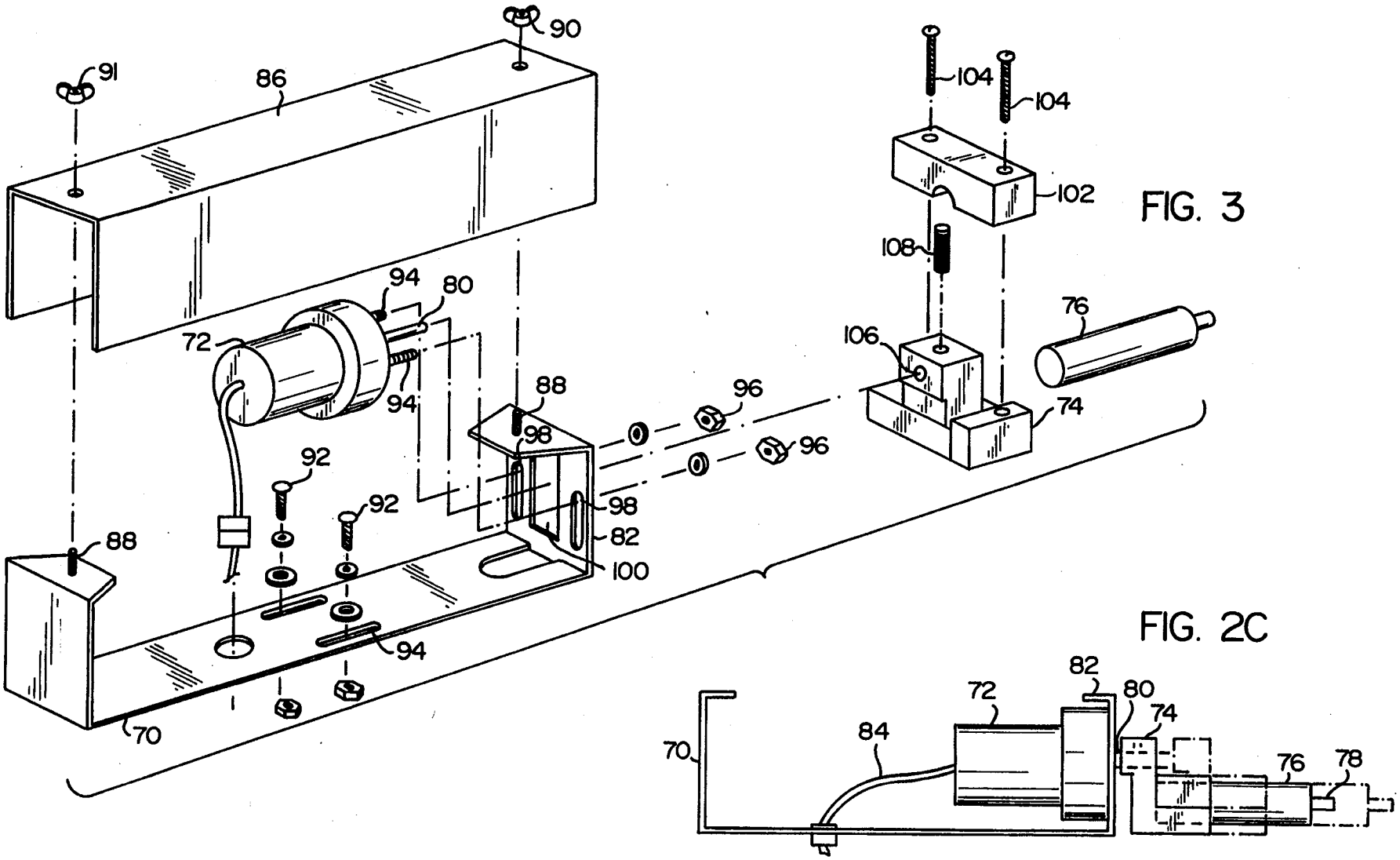
FIG. 2C is a side view of a specific embodiment of the zip break marker mechanism in accordance with the invention.
FIG. 3 is a detailed expanded view illustrating a specific embodiment of the zip break marker mechanism in accordance with the invention.

FIG. 2C is a detailed diagrammatic side view of a specific embodiment of the zip break marker 60 mechanism. A solenoid 72 is mounted on the front wall 82 of the housing base 70 such that a solenoid shaft 80 extends through the front wall 82 to bracket 74 in which the marker 76 is mounted. In the illustrated embodiment, the solenoid 72 may be activated via line 84 which is coupled to the tracking control circuitry (see FIG. 4). The solenoid 72 may be activated to a retracted position, shown in solid lines, or an extended position, shown in broken lines. In the extended position, the tip 78 contacts and marks the edge of any passing mail piece.

FIG. 3 is a detailed expanded view illustration of a specific embodiment of the zip break marker 60 including a housing cover 86 secured to the housing base 70 by two bolts 88 and wing nuts 90, as shown. The housing 70 is mounted to the surface of the tracker 14 using a pair of screw/washer nut sets 92 inserted through elongated openings 94 to permit position adjustment. The solenoid 72 is mounted on the front wall 82 with bolts 94 and nuts 96 through elongated slots 98 with the shaft 80 extending through an opening 100. The marker 76 is held in the bracket 74 by a slotted member 102 and fastened by two screws 104 to tightly hold the marker 76. The bracket 74 is secured to the shaft 80 of the solenoid 72. To secure the solenoid 72 to the bracket 74, the solenoid shaft 80 is inserted into an opening 106 in the bracket 74 and secured by a set screw 108, as shown.

Figure 4:
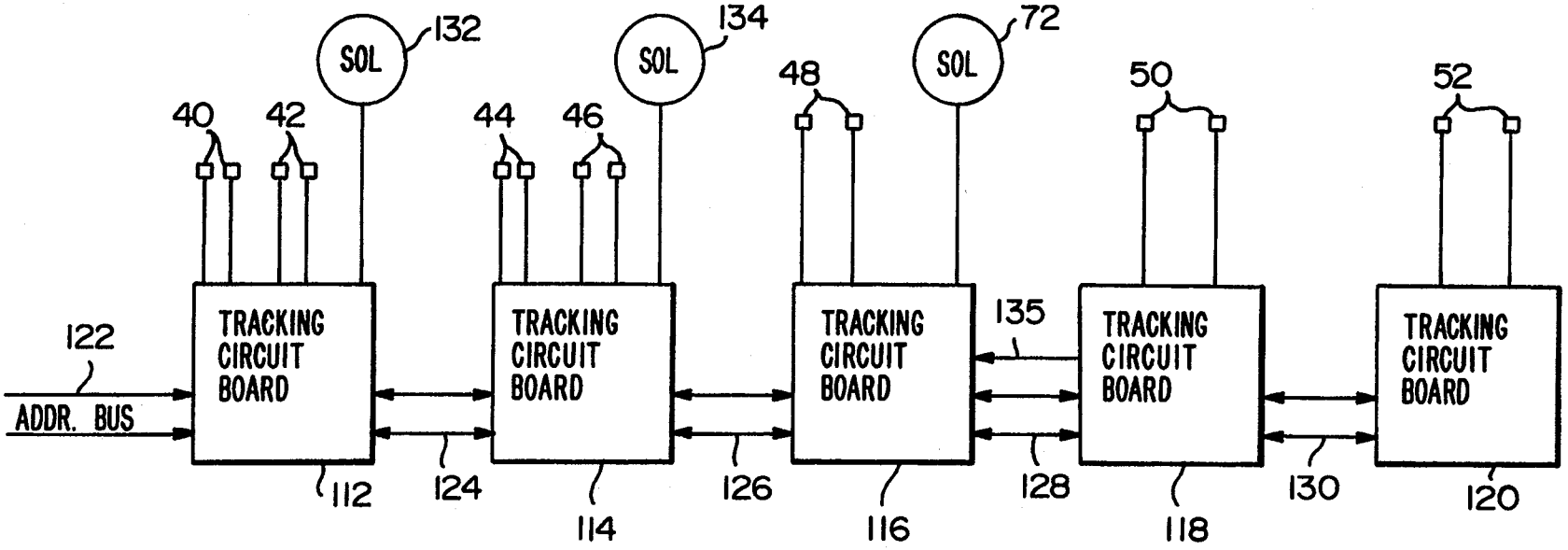
FIG. 4 is a schematic block diagram of a specific embodiment of the control circuitry for the zip break marker tracker in accordance with the invention.

Referring to FIG. 4, there is shown a schematic block diagram of a specific embodiment of a tracking control circuit 110 for the system 10 of FIG. 1 comprising five tracking circuits 112, 114, 116, 118, 120, as shown. These tracking circuits are known in the art, for example, are presently installed in the Model 1400 mail processor marketed by Bell & Howell, Phillipsburg Company, Evanston, Illinois. Solenoids 132, 134 and 72 are coupled respectively to the tracking circuits 112, 114, and 116, as shown. In addition, the photodetector pairs 40, 42, 44, 46, 48, 50, 52 are coupled to their respective illustrated tracking control circuits. Addresses and control signals from the central computer 19 are coupled via a bus 122 to the first tracking circuit 112, which couples the addresses and control signals through to the tracking circuit 114 via the address bus 124. Similarly, the addresses and control signals are coupled in sequence to each of the tracking circuits 116, 118, and 120 via the address buses 126, 128 and 130. An address associated with each document on the transport path is generated by the processor 19. Each tracking control circuit 112, 114, 116, 118, 120 has a unique address.

The addresses coupled to the tracking circuits enable a selected one of the circuits 112, 114, 116, 118 to generate a control signal to, for example, activate its respective solenoid in response to mail piece detection by the associated photodetector pairs. Thus, if the first tracking circuit 112 is addressed, detection of a mail piece by the photodetector pairs 40, 42 will cause the circuit 112 to activate the solenoid 132, thereby moving the gate 54 (see FIG. 2A) diverting the mail piece into the tray 22. Similarly, if the second tracking circuit 114 is addressed, a detection of the mail piece by the photodetector pairs 44, 46 will cause the circuit 114 to activate the solenoid 134, thereby pivoting the gate 56 to divert the mail piece into the tray 24. If the third tracking circuit 116 is addressed, indicating the next mail piece is the beginning of a new zip code, detection of the mail piece by the photodetector pair 48 will cause the circuit 116 to activate the solenoid 72, thereby extending the marker 76 to mark the edge of the mail piece. This same address then activates the next tracker circuit 118 which generates a control signal coupled to the circuit 116 via a conductor 135 in response to detection of the mail piece by the photodetector pair 50. The control signal resets the circuit 116 from the active state causing the solenoid 72 to retract the marker 76 a short time after it was extended so that only a small mark is made at the edge of the mail piece. The tracking circuit 120 detects the mail piece leaving the tracker 14 and entering into the stacker 16.

Specific embodiments of the novel zip break marking tracker have been described for the purpose of illustrating the manner in which the invention may be made and used. It should be understood that implementation of other variations and modifications of the invention in its various aspects will be apparent to those of ordinary skill in the art and that the invention is not limited by the specific embodiments described. It is therefore contemplated to cover by the present invention any and all modifications, variations or equivalents that fall within the true spirit and scope of the underlying principles disclosed and claimed herein.

What is claimed is:

1. Apparatus for tracking and marking objects transported along a transport path comprising:

means for tracking the position of an object and generating position signals indicative of the position of the object in the transport path;

processor means for producing control signals indicative of whether a zip break mark is to be made on the object;

marking means for marking a surface of an object with a mark suitable for indicating a zip break;

mounting means positioned in proximity to the transport path for movably mounting the marking means;

means for acting on the mounting means to position the marking means between a first position in which the marking means can contact a passing object in the transport path and a second position in which the marking means cannot contact a passing object in the transport path; and control means for receiving said control signals from said processor means and said position signals from said means for tracking, and for controlling the means for acting to position the marking means in the first position to mark a selected passing object in response to the position signals and the control signals, and to position the marking means in the second position in response to the position signals.

2. The apparatus of claim 1 wherein the means for tracking comprises a plurality of sensors positioned along the transport path including a first sensor and second sensor positioned in close proximity to the mounting means, the first sensor positioned prior to the mounting means along the transport path and the second sensor positioned after the mounting means along the transport path, and wherein the first sensor generates a first position signal in response to detecting a passing object on the transport path and the second sensor generates a second signal in response to detecting the passing object on the transport path.

3. The apparatus of claim 2 wherein the control means controls the means for acting to position the marking means to the first position in response to the first position signal and the control signals, and to position the marking means to the second position in response to the second position signal.

4. The apparatus of claim 3 wherein the marking comprises a felt tip marker.

5. The apparatus of claim 3 wherein the means for controlling controls the means for acting to position the marking means to the second position in response to the second position signal and the control signals.

6. The apparatus of claim 3 wherein the first and second sensor each comprise an optical signal emitter and an optical signal detector.

7. The apparatus of claim 2 wherein the means for acting is an electric solenoid.

8. The apparatus of claim 2 wherein the means for tracking further comprises a third sensor for generating a third position signal in response to an object passing the third sensor on the transport path, and further comprising a gating means for directing a selected object from the transport path into a first t tray in response to the third position signal and the control signals.

9. The apparatus of claim 8 wherein the means for tracking comprises a fourth sensor for generating a fourth position signal in response to an object passing the fourth sensor on the transport path, and further comprising a gating means for directing a selected object from the transport path into a second tray in response to the fourth position signal and the control signals.

10. The apparatus of claim 1 wherein the processor means produces control signals comprising an address signal associated with each object transported along the transport path.

* * * * *